US008820285B2

(12) United States Patent
Kaneko et al.

(10) Patent No.: US 8,820,285 B2
(45) Date of Patent: Sep. 2, 2014

(54) PLASMA DEVICE

(71) Applicant: Imagineering, Inc., Kobe (JP)

(72) Inventors: Masashi Kaneko, Kobe (JP); Yuji Ikeda, Kobe (JP)

(73) Assignee: Imagineering, Inc., Kobe-shi (JP)

( * ) Notice: Subject to any disclaimer, the term of this patent is extended or adjusted under 35 U.S.C. 154(b) by 0 days.

(21) Appl. No.: 14/024,976

(22) Filed: Sep. 12, 2013

(65) Prior Publication Data

US 2014/0014053 A1 Jan. 16, 2014

Related U.S. Application Data

(63) Continuation of application No. 13/982,564, filed as application No. PCT/JP2012/052168 on Jan. 31, 2012.

(30) Foreign Application Priority Data

Jan. 31, 2011 (JP) ..... 2011-019044

(51) Int. Cl.
*F02P 23/00* (2006.01)
*F02B 51/04* (2006.01)

(52) U.S. Cl.
USPC ..... 123/143 B; 123/536

(58) Field of Classification Search
USPC ..... 123/143 B, 536
See application file for complete search history.

(56) References Cited

U.S. PATENT DOCUMENTS 5,173,641 A 12/1992 Imahashi et al.
8,240,293 B2 8/2012 Ikeda
8,365,707 B2 * 2/2013 Ikeda ..... 123/536
8,464,695 B2 * 6/2013 Ikeda ..... 123/539
8,485,162 B2 * 7/2013 Ikeda ..... 123/536
8,495,989 B2 * 7/2013 Ikeda ..... 123/536
2008/0135007 A1 6/2008 Storm
2009/0229581 A1 9/2009 Ikeda
2011/0023458 A1 * 2/2011 Ikeda ..... 60/275
2011/0025210 A1 2/2011 Ikeda
2011/0030347 A1 * 2/2011 Ikeda ..... 60/275
2011/0030660 A1 * 2/2011 Ikeda ..... 123/536
2012/0240873 A1 * 9/2012 Ikeda ..... 123/3

FOREIGN PATENT DOCUMENTS

EP 2264308 A1 12/2010
JP 59-70886 A 4/1984
JP 04-124275 A 4/1992
JP 05-144772 A 6/1993
JP 2007-113570 A 5/2007

(Continued)

OTHER PUBLICATIONS

International Search Report for PCT/JP2012/052168, Mailing Date of Jul. 24, 2012.

*Primary Examiner* — Hai Huynh
(74) *Attorney, Agent, or Firm* — Westerman, Hattori, Daniels & Adrian, LLP

(57) ABSTRACT

In a plasma device 30 that emits an electromagnetic wave to a combustion chamber 10 of an engine 20 so as to generate electromagnetic wave plasma thereby igniting mixture gas, fuel efficiency for lean burn mixture combustion of an engine 20 is improved. During a flame propagation after the mixture gas is ignited in the combustion chamber, the electromagnetic wave is emitted to the combustion chamber 10 so that electrons in a propagating flame resonate with the electromagnetic wave. The resonance between the electrons in the propagating flame and the electromagnetic wave increases flame propagation speed.

6 Claims, 4 Drawing Sheets

(56) References Cited

FOREIGN PATENT DOCUMENTS

| | | | |
|---|---|---|---|
| JP | 2009-38025 | A | 2/2009 |
| JP | 2010-512483 | A | 4/2010 |
| WO | 2008/070820 | A2 | 6/2008 |
| WO | 2009/113693 | A1 | 9/2009 |

* cited by examiner

PLASMA DEVICE

CROSS-REFERENCE OF RELATED APPLICATIONS

This application is a Divisional of application Ser. No. 13/982,564, filed Jul. 30, 2013, which is a 371 of International Application No. PCT/JP2012/052168, filed Jan. 31, 2012, which claims priority of Japanese Patent Application No. 2011-019044, filed Jan. 31, 2011, the entire contents of which are incorporated herein by reference.

TECHNICAL FIELD

The present invention relates to a plasma device that ignites mixture gas by emitting an electromagnetic wave to a combustion chamber of an engine so as to generate electromagnetic wave plasma.

BACKGROUND ART

Conventionally, there is known a plasma device that ignites mixture gas by emitting an electromagnetic wave to a combustion chamber of an engine so as to generate electromagnetic wave plasma. For example, Japanese Unexamined Patent Application, Publication No. 2009-38025 discloses a plasma device of this kind.

More particularly, Japanese Unexamined Patent Application, Publication No. 2009-38025 discloses a plasma enhancement device that causes a spark discharge at a discharge gap of a spark plug, while emitting a microwave toward the discharge gap. In the plasma enhancement device, plasma generated due to the spark discharge receives energy from the microwave pulse. As a result of this, electrons in a region of the plasma are accelerated so as to promote ionization and increase the plasma in volume.

Since this kind of plasma device can generate plasma stronger than discharge plasma generated by a spark discharge, it is possible to ignite lean mixture gas in a combustion chamber of an engine. However, since propagation speed of a flame decreases as the mixture gas is made leaner, the amount of unburned mixture gas increases in exhaust emission. Therefore, if the mixture gas is made leaner, although fuel efficiency of the engine is improved, the improvement in fuel efficiency is degraded by the amount of increase in unburned mixture gas.

SUMMARY OF THE INVENTION

The present invention has been made in view of the above described circumstances, and it is an object of the present invention to improve fuel efficiency of lean burn combustion of an engine in a plasma device that ignites mixture gas by emitting an electromagnetic wave to a combustion chamber of the engine so as to generate electromagnetic wave plasma.

In accordance with a first aspect of the present invention, there is provided a plasma device including an electromagnetic wave emission unit that emits an electromagnetic wave to a combustion chamber of an engine. The plasma device causes the electromagnetic wave emission unit to emit the electromagnetic wave to the combustion chamber so as to generate electromagnetic wave plasma at a timing of igniting mixture gas in the combustion chamber, thereby igniting the mixture gas. The plasma device further includes a flame acceleration unit that controls the electromagnetic wave emission unit to emit the electromagnetic wave to the combustion chamber during a flame propagation after the mixture gas is ignited so that electrons in the propagating flame resonate with the emitted electromagnetic wave, thereby increasing flame propagation speed.

According to the first aspect of the present invention, the electromagnetic wave emission unit emits the electromagnetic wave to the combustion chamber during the flame propagation after the mixture gas is ignited so that electrons in the propagating flame resonate with the emitted electromagnetic wave. As a result of this, electrons in the propagating flame are efficiently accelerated, and the flame propagation speed is increased.

In accordance with a second aspect of the present invention, in addition to the first aspect of the present invention, the flame acceleration unit controls, during the flame propagation, the electromagnetic wave emission unit to emit an electromagnetic wave of a frequency configured in view of a frequency of plasma oscillation on a propagating flame surface so that the plasma oscillation resonates with the emitted electromagnetic wave.

According to the second aspect of the present invention, an electromagnetic wave of a frequency, which is configured in view of the frequency of the plasma oscillation so that the plasma oscillation on the propagating flame surface resonates with the electromagnetic wave, is emitted to the combustion chamber during the flame propagation. Since the plasma oscillation resonates with the electromagnetic wave, electrons in the propagating flame are effectively accelerated, and the flame propagation speed is increased.

In accordance with a third aspect of the present invention, in addition to the first aspect of the present invention, at a time when the propagating flame passes through a predetermined acceleration location during the flame propagation, the flame acceleration unit causes the electromagnetic wave emission unit to emit the electromagnetic wave, while creating a magnetic field for gyrating electrons in the flame at the acceleration location with a frequency resonating with the emitted electromagnetic wave.

According to the third aspect of the present invention, at the time when the propagating flame passes through the acceleration location during the flame propagation, the magnetic field is created for gyrating electrons in the flame at the acceleration location with the frequency resonating with the emitted electromagnetic wave. As a result of this, electrons in the propagating flame are effectively accelerated, and the flame propagation speed is improved.

In accordance with a fourth aspect of the present invention, in addition to the third aspect of the present invention, the engine is a reciprocating engine in which a piston reciprocates. The electromagnetic wave emission unit emits the electromagnetic wave from an antenna mounted on a cylinder head facing toward the piston. The flame acceleration unit includes an electric wire for creating a magnetic field. The electric wire is disposed on the cylinder head so as to surround the antenna. The acceleration unit further includes a control unit for acceleration that causes the electromagnetic wave emission unit to emit the electromagnetic wave at the time when the propagating flame passes through the acceleration location, while causing an electric current to flow through the electric wire.

According to the fourth aspect of the present invention, at the time when the propagating flame passes through the acceleration location, the electric wire is supplied with the electric current so that the magnetic field is created for gyrating electrons in the flame at the acceleration location with the frequency resonating with the emitted electromagnetic wave. Therefore, electrons in the entire propagating flame are effectively accelerated.

In accordance with a fifth aspect of the present invention, in addition to the first to fourth aspects of the present invention, the plasma device includes an ionization unit that ionizes gas in the combustion chamber. At a timing of igniting mixture gas in the combustion chamber, the plasma device causes the ionization unit to ionize the gas in the combustion chamber, while causing the electromagnetic wave emission unit to emit the electromagnetic wave to the combustion chamber, thereby generating electromagnetic wave plasma.

According to the fifth aspect of the present invention, at the timing of igniting the mixture gas in the combustion chamber, the ionization unit ionizes the gas in the combustion chamber so that free electrons are discharged. The free electrons are accelerated by the electromagnetic wave emitted from the electromagnetic wave emission unit. As a result of this, electromagnetic wave plasma is generated.

According to the present invention, during the flame propagation in the combustion chamber, electrons in the propagating flame are caused to resonate with the emitted electromagnetic wave so that the electrons in the flame are efficiently energized, thereby increasing the flame propagation speed. As a result of this, when lean mixture gas is combusted, the amount of exhausted unburned mixture gas decreases. Accordingly, since engine output is increased against fuel input in the combustion chamber, it is possible to improve fuel efficiency of the engine.

EMBODIMENTS OF THE INVENTION

Figure 1:
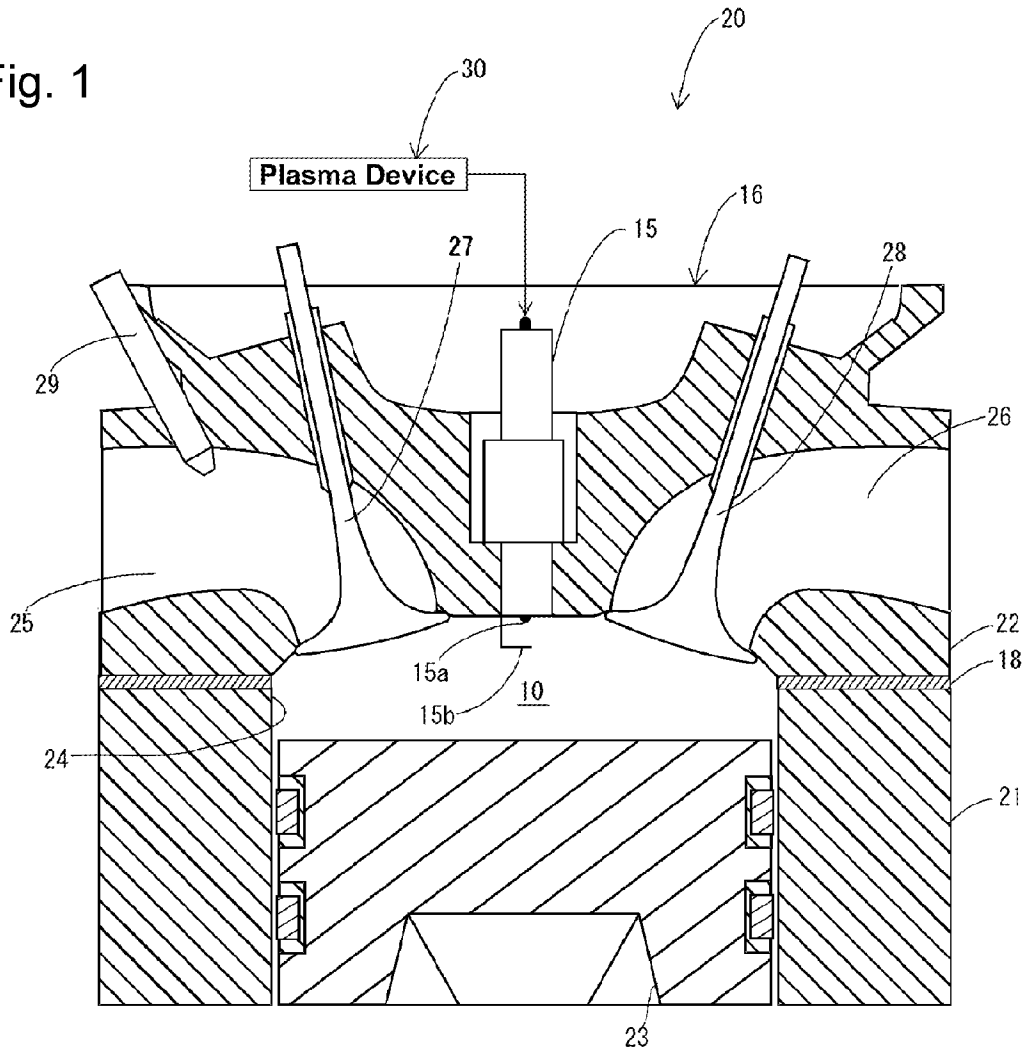
FIG. 1 is a schematic configuration view of an engine according to a first embodiment.

In the following, a detailed description will be given of embodiments of the present invention with reference to drawings. It should be noted that the following embodiments are merely preferable examples, and do not limit the scope of the present invention, applied field thereof, or application thereof.

First Embodiment

The first embodiment is directed to an engine 20 provided with a plasma device 30 that emits an electromagnetic wave to a combustion chamber 10 so as to generate electromagnetic wave plasma (such as microwave plasma), thereby igniting mixture gas. The engine 20 is a reciprocal type plasma ignition engine, in which a piston 23 reciprocates. The engine 20 is provided with an engine main body 16 and the plasma device 30.

As shown in FIG. 1, the engine main body 16 is provided with a cylinder block 21, a cylinder head 22, and the pistons 23. The cylinder block 21 is formed with a plurality of cylinders 24 each having a circular cross section. Inside of each cylinder 24, the piston 23 is reciprocatably mounted. The piston 23 is connected to a crankshaft (not shown) via a connecting rod (not shown). The crankshaft is rotatably supported by the cylinder block 21. While the piston 23 reciprocates in each cylinder 24 in an axial direction of the cylinder 24, the connecting rod converts the reciprocation movement of the piston 23 into rotation movement of the crankshaft.

The cylinder head 22 is placed on the cylinder block 21, and a gasket 18 intervenes between the cylinder block 21 and the cylinder head 22. The cylinder head 22 partitions the combustion chamber 10 along with the cylinder 24 and the piston 23.

The cylinder head 22 is provided with one spark plug 15 for each cylinder 24. The spark plug 15 is attached to the cylinder head 22 so that a discharge gap between a central electrode 15*a* and a ground electrode 15*b* is located in the combustion chamber 10.

The cylinder head 22 is formed with an intake port 25 and an exhaust port 26 for each cylinder 24. The intake port 25 is provided with an intake valve 27 for opening and closing the intake port 25, and an injector 29 for injecting fuel. In the first embodiment, the fuel injected from the injector 29 is supplied to air flowing through the intake port 25. On the other hand, the exhaust port 26 is provided with an exhaust valve 28 for opening and closing the exhaust port 26.

Figure 2:
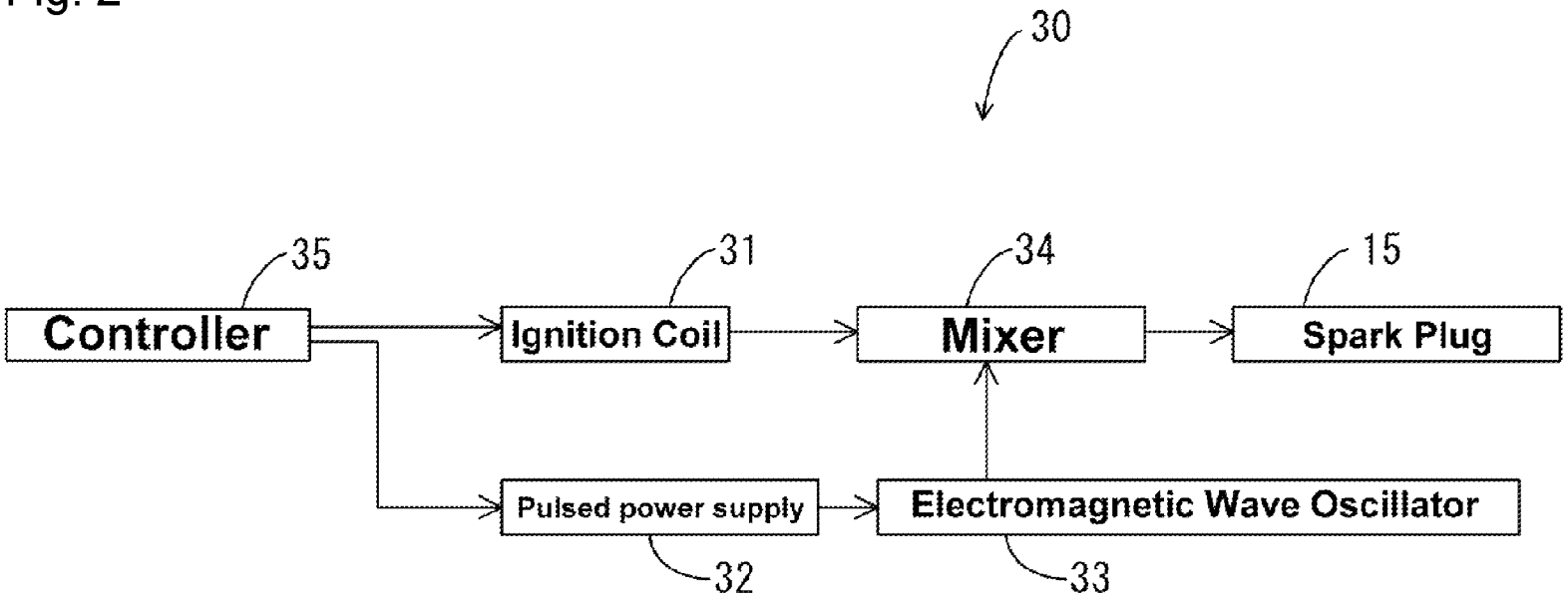
FIG. 2 is a schematic configuration diagram of a plasma device according to the first embodiment.

As shown in FIG. 2, the plasma device 30 is provided with an ignition coil 31, the above described spark plug 15, a pulsed power supply 32, an electromagnetic wave oscillator 33, a mixer 34, and a controller 35. The ignition coil 31 constitutes a pulse generator for generating a high voltage pulse. The electromagnetic wave oscillator 33 is, for example, a magnetron or a semiconductor oscillator. The spark plug 15 is a discharger for causing a discharge, upon receiving the high voltage pulse, and constitutes an ionization unit for ionizing gas in the combustion chamber 10. The controller 35 is mounted in, for example, an ECU (Electronic Control Unit) for controlling the engine 20.

The ignition coil 31 is connected to a 12 V battery (not shown) of a vehicle. The ignition coil 31, upon receiving an ignition signal from the controller 35, outputs a high voltage pulse to the mixer 34. The pulsed power supply 32, upon receiving an electromagnetic wave oscillation signal from the controller 35, supplies a pulse current to the electromagnetic wave oscillator 33. The electromagnetic wave oscillator 33, upon receiving the pulse current, outputs an electromagnetic wave pulse to the mixer 34. The mixer 34 mixes the high voltage pulse and the electromagnetic wave pulse and outputs them to the central electrode 15*a* of the spark plug 15.

In the plasma device 30, when the high voltage pulse and the electromagnetic wave pulse are simultaneously supplied to the central electrode 15*a* of the spark plug 15, a spark discharge is caused at the discharge gap of the spark plug 15, and discharge plasma generated by the spark discharge is irradiated with the electromagnetic wave from the central electrode 15*a*. The central electrode 15*a* functions as an antenna for electromagnetic wave. The discharge plasma generated by the spark discharge absorbs the electromagnetic wave energy and expands. In this manner, the plasma device 30 generates non-equilibrium electromagnetic wave plasma. Mixture gas in the combustion chamber 10 is volume ignited by the electromagnetic wave plasma immediately before the piston 23 reaches the top dead center. The electromagnetic wave plasma disappears immediately after the mixture gas is ignited.

The pulsed power supply 32, upon receiving the electromagnetic wave oscillation signal, outputs the pulse current for a predetermined time interval at a predetermined duty cycle. The electromagnetic wave oscillator 33 outputs the electromagnetic wave pulse for the time interval. When the time interval has elapsed after a rise time of the electromagnetic wave oscillation signal, oscillation of the electromagnetic wave pulse is terminated, and the electromagnetic wave plasma disappears.

In the first embodiment, the pulsed power supply 32, the electromagnetic wave oscillator 33, the mixer 34, and the spark plug 15 constitute an electromagnetic wave emission unit that emits the electromagnetic wave to the combustion chamber 10 of the engine 20. The controller 35 constitutes an ignition control unit that causes the electromagnetic wave emission unit to emit the electromagnetic wave at an ignition timing, at which the mixture gas is ignited in the combustion chamber 10. The controller 35 outputs the ignition signal and the electromagnetic wave oscillation signal at the ignition timing, which is defined as a timing immediately before the piston 23 reaches the top dead center in a compression stroke.

In the first embodiment, the controller 35 constitutes a flame acceleration unit that controls the electromagnetic wave emission unit to emit the electromagnetic wave to the combustion chamber 10 during a flame propagation in the combustion chamber 10 so that electrons in the propagating flame resonate with the emitted electromagnetic wave, thereby increasing a flame propagation speed. At a timing of increasing the flame propagation speed, the electromagnetic wave plasma has already disappeared. The controller 35 outputs the electromagnetic wave oscillation signal to the pulsed power supply 32 at a predetermined timing during the flame propagation so as to cause the electromagnetic wave oscillator 33 to oscillate the electromagnetic wave and to cause the central electrode 15*a* of the spark plug 15 to emit the electromagnetic wave.

After the mixture gas is volume ignited by the electromagnetic wave plasma, combustion reaction spreads to the whole combustion chamber 10 by the flame propagation. The flame propagation spreads outwardly from an ignition location (central location of the combustion chamber 10) of the mixture gas toward a cylinder wall. The controller 35 controls via the pulsed power supply 32 the electromagnetic wave oscillator 33 so that the electromagnetic wave is emitted to the combustion chamber 10 synchronously when a propagating flame surface reaches an acceleration location, which is a location expected for the propagating flame to be accelerated. No spark discharge is caused at this time. The acceleration location is configured to be, for example, approximately a midpoint of a line connecting a central axis of the combustion chamber 10 and the cylinder wall.

An oscillatory frequency of the electromagnetic wave oscillator 33 is configured in view of a frequency fp of a plasma oscillation on the propagating flame surface passing through the acceleration location so that the plasma oscillation on the propagating flame surface at the acceleration location resonates with the electromagnetic wave emitted to the combustion chamber 10. More particularly, the oscillatory frequency of the electromagnetic wave oscillator 33 is set to the same value as the frequency fp of the plasma oscillation on the propagating flame surface passing through the acceleration location (hereinafter, referred to as a "target frequency"). The oscillatory frequency of the electromagnetic wave oscillator 33 may be determined to be a value approximately equal to the target frequency fp.

The frequency of plasma oscillation in the flame depends on electron density Ne, and is determined by the following equation (1).

$$fp\ (\mathrm{Hz}) = 9000 \times \sqrt{(Ne)} \quad (1)$$

In equation (1), the unit of Ne is $cm^{-3}$.

Assuming that the electron density Ne in the flame passing through the acceleration location (hereinafter, referred to as "target electron density") is $10^{10}$ to $10^{15}$ $cm^{-3}$, a millimeter wave band oscillator having an oscillatory frequency of 0.9 GHz to 285 GHz is employed as the electromagnetic wave oscillator 33. The target electron density Ne changes in accordance with, for example, ratio of fuel and air in the mixture gas and location of the acceleration location in the combustion chamber 10. The target electron density Ne is acquired in advance by means of measurement or the like, and based on the acquired value of Ne, the oscillatory frequency of the electromagnetic wave oscillator 33 is determined.

An emission timing of the electromagnetic wave is controlled by the electromagnetic wave oscillation signal outputted from the controller 35. The controller 35 outputs the electromagnetic wave oscillation signal at the ignition timing as well as at a timing delayed from the ignition timing by a predetermined crank angle. The timing delayed from the ignition timing is configured in advance to the controller 35 so as to coincide with a timing for the propagating flame to reach the acceleration location.

Effect of First Embodiment

In the first embodiment, since the plasma oscillation can resonate with the electromagnetic wave, it is possible to effectively accelerate electrons in the propagating flame. Due to high speed electrons generated in the propagating flame, it is possible to improve combustion speed. In a case in which the combustion speed is low for a reason such as lean mixture gas, since it is difficult to combust all the fuel before the piston reaches the bottom dead center in an expansion stroke, a relatively large amount of unburned hydrocarbon exhaust is emitted. According to the first embodiment, it is possible to reduce the amount of unburned exhaust emission by improving the combustion speed as the effect of the high speed electrons, thereby improving fuel efficiency.

Modified Example of First Embodiment

Figure 3:
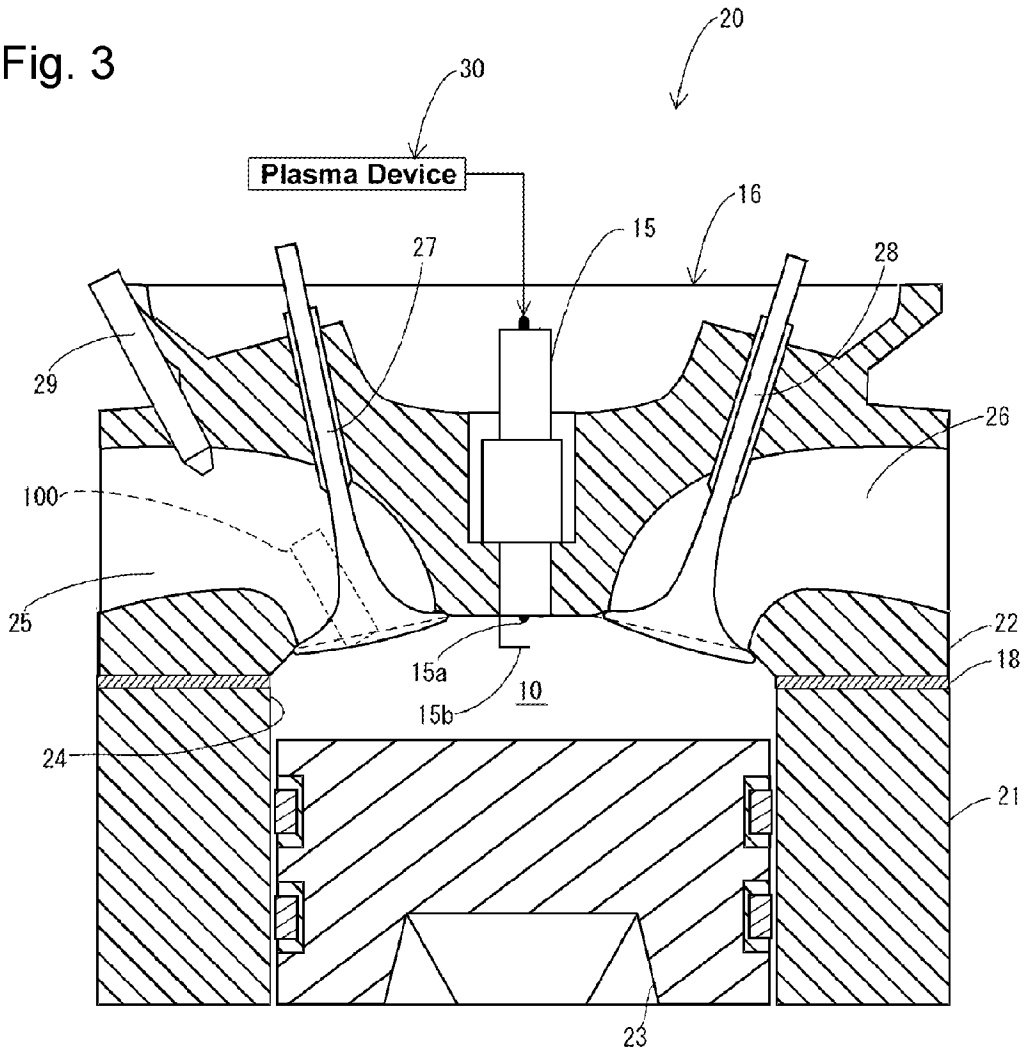
FIG. 3 is a schematic configuration view of an engine according to a modified example of the first embodiment.

In the present modified example, as shown in FIG. 3, the engine main body 16 is provided with an ion probe 100 for detecting the arrival of the propagating flame surface at the acceleration location where the propagating flame is expected to be accelerated. The ion probe 100 is located at the acceleration location. For example, the ion probe 100 is disposed so as to be exposed to the combustion chamber 10 from between the intake ports 25 on the cylinder head 22. The controller 35, upon receiving a flame surface arrival signal from the ion probe 100, outputs the electromagnetic wave oscillation signal to the pulsed power supply 32.

Second Embodiment

A second embodiment will be described hereinafter only as to points different from those of the first embodiment.

A plasma device 30 according to the second embodiment is provided with a coil 200 (electric wire) for creating a magnetic field at the acceleration location, so as to gyrate electrons in the propagating flame at a frequency, which resonates with the electromagnetic wave (for example, of 2.45 GHz) emitted to the combustion chamber 10.

Figure 4:
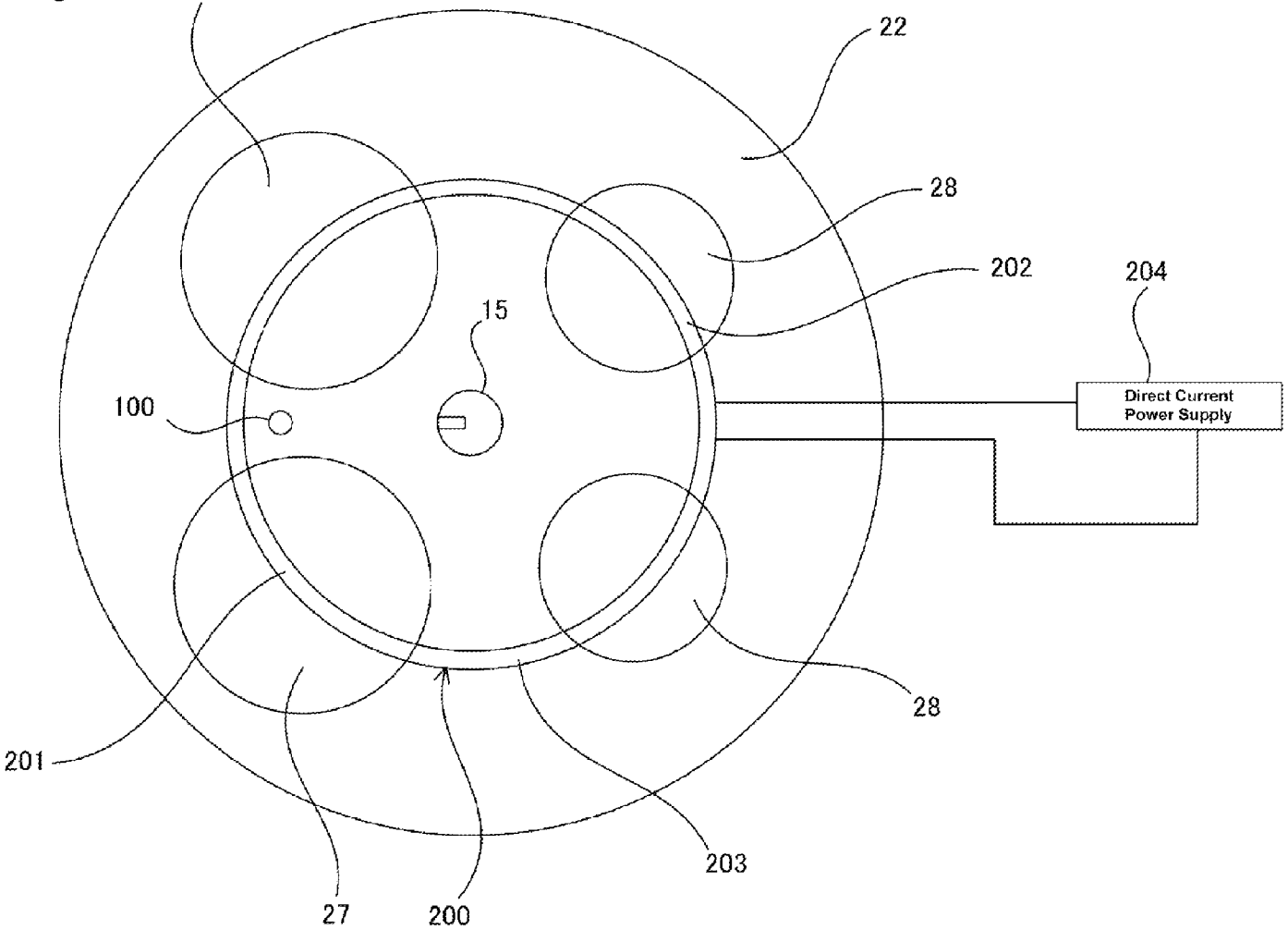
FIG. 4 is a schematic configuration view of a cylinder head of an engine according to a second embodiment.

As shown in FIG. 4, the coil 200 includes an intake valve passing part 201 located on a valve head (a surface exposed to the combustion chamber 10) of each intake valve 27, an exhaust valve passing part 202 located on a valve head of each exhaust valve 28, and a head passing part 203 located on a surface of the cylinder head 22 exposed to the combustion chamber 10. The coil 200 is formed as a coil when electrical connection is formed among the intake valve passing part 201, the exhaust valve passing part 202, and the head passing part 203 during an explosion stroke in which both the intake valves 27 and the exhaust valves 28 are closed. In this state, the coil 200 surrounds an ignition location (location of the spark plug 15) of mixture gas by way of the electromagnetic wave plasma. The coil 200 is connected to a direct current power supply 204 for applying a direct current to the coil 200.

The controller 35 constitutes a control unit for acceleration that controls the electromagnetic wave oscillator 33 to emit the electromagnetic wave to the combustion chamber 10 and controls a direct current power supply 204 to apply an electric current to the coil 200, at a time when the propagating flame is passing through the acceleration location during the flame propagation. In the second embodiment, the coil 200 and the controller 35 constitute a flame acceleration unit. In the second embodiment, viewing the combustion chamber 10 from an axial direction thereof, the acceleration location coincides with a location of the coil 200.

More particularly, the controller 35 outputs a magnetic field creation signal to the direct current power supply 204 and an electromagnetic wave oscillation signal to the pulsed power supply 32, in synchronization with an arrival timing of the propagating flame surface at the acceleration location. A timing of outputting these control signals is configured in advance to the controller 35 so as to coincide with the arrival timing of the propagating flame at the acceleration location. The controller 35 outputs the magnetic field creation signal to the direct current power supply 204 and the electromagnetic wave oscillation signal to the pulsed power supply 32 with a delay corresponding to a predetermined crank angle from the ignition timing.

Similarly to the modified example of the first embodiment, the controller 35 may output the magnetic field creation signal and the electromagnetic wave oscillation signal after an ion probe 100 detects an arrival of the propagating flame surface at the acceleration location. In this case, the ion probe 100 is located slightly inwardly from the coil 200 so as to prevent interference with the coil 200.

The direct current power supply 204, upon receiving the magnetic field creation signal, applies an electric current to the coil 200. As a result of this, a magnetic field of a predetermined intensity is created in the combustion chamber 10, and a resonance layer is formed at the acceleration location. The electric current is set in advance to a value required to create a magnetic field having a magnetic flux density B (875 gauss, for example) on the propagating flame surface at the acceleration location. The magnetic flux density B is determined using the following equation (2).

$$f_ce=(e\times B)/(2\pi\times m_e) \quad (2)$$

In the above equation (2), f_ce represents electron cyclotron frequency (Hz), e represents elementary charge (coulomb), B represents magnetic flux density (tesla, 1 tesla=10000 gauss), and m_e represents electron mass (kg).

The pulsed power supply 32, upon receiving the electromagnetic wave oscillation signal, generates a pulse current. The electromagnetic wave oscillator 33, upon receiving the pulse current, oscillates an electromagnetic wave. The electromagnetic wave oscillated by the electromagnetic wave oscillator 33 is emitted from the central electrode 15*a* to the combustion chamber 10.

According to the above described operation, in the combustion chamber 10, electrons in the propagating flame at the acceleration location gyrates with the same frequency as the electromagnetic wave emitted to the combustion chamber 10 due to the magnetic field created by the coil 200. As a result of this, the gyrating movement of the electrons resonates with the electromagnetic wave, and the electrons are effectively accelerated.

Effect of Second Embodiment

In the second embodiment, it is possible to improve combustion speed by the high speed electrons generated in the flame. Accordingly, it is possible to combust fuel, which would otherwise be exhausted unburned, and improve fuel efficiency.

First Modified Example of Second Embodiment

In the second embodiment, the flame acceleration unit may be a permanent magnet that creates a magnetic field at the acceleration location.

Second Modified Example of Second Embodiment

In the second embodiment, the coil 200 may be disposed outside of the engine main body 16. In this case, the engine main body 16 is configured by non-magnetic material.

Other Embodiments

The above described embodiments may also be configured as follows.

In the embodiments described above, the plasma device 30 may be configured so as to generate the electromagnetic wave plasma by way of the electromagnetic wave alone without including any discharger such as the spark plug 15.

Furthermore, in the embodiments described above, the high voltage pulse and the electromagnetic wave may be applied to separate places. In this case, an antenna for electromagnetic wave is provided separately from the central electrode 15*a* of the spark plug 15. Without requiring the mixer 34, the ignition coil 31 is directly connected to the spark plug 15, and the electromagnetic wave oscillator 33 is directly connected to the antenna for electromagnetic wave. Here, the pulsed power supply 32, the electromagnetic wave oscillator 33, and the antenna for electromagnetic wave constitute the electromagnetic wave emission unit. The antenna for electromagnetic wave may be integrated into the spark plug 15, or may be mounted on the cylinder head 22 separately from the spark plug 15.

INDUSTRIAL APPLICABILITY

The present invention is useful in relation to a plasma device that ignites mixture gas by emitting an electromagnetic wave to a combustion chamber of an engine so as to generate electromagnetic wave plasma.

EXPLANATION OF REFERENCE NUMERALS

10 Combustion Chamber
15 Spark Plug (Ionization Unit)
15*a* Central Electrode (Electromagnetic Wave Emission Unit)
16 Engine Main Body
20 Engine
30 Plasma Device
35 Controller (Ignition Control Unit, Flame Acceleration Unit)

What is claimed is:

1. A plasma device, comprising:

an antenna mounted on a cylinder head facing toward the piston that emits an electromagnetic wave to a combustion chamber so as to generate electromagnetic wave plasma at a timing of igniting mixture gas in the combustion chamber, thereby igniting the mixture gas, and an electric wire for creating a magnetic field, the electric wire being disposed on the cylinder head so as to surround the antenna, and a control unit for acceleration that accelerates the propagating speed of flame of the ignited mixture gas by controlling the amount of an electric current that flows through the electric wire.

2. The plasma device according to claim 1, wherein the engine is a reciprocating engine in which a piston reciprocates, the electromagnetic wave emission unit emits the electromagnetic wave from an antenna mounted on a cylinder head facing toward the piston, and the flame acceleration unit includes an electric wire for creating a magnetic field, the electric wire being disposed on the cylinder head so as to surround the antenna, and a control unit for acceleration that causes the electromagnetic wave emission unit to emit the electromagnetic wave at the time when the propagating flame passes through the acceleration location, while causing an electric current to flow through the electric wire.

3. The plasma device according to claim 1, further comprising an ionization unit that ionizes gas in the combustion chamber, wherein the plasma device, at a timing of igniting mixture gas in the combustion chamber, causes the ionization unit to ionize the gas in the combustion chamber, while causing the electromagnetic wave emission unit to emit the electromagnetic wave to the combustion chamber, thereby generating electromagnetic wave plasma.

4. The plasma device according to claim 1, further comprising an ionization unit that ionizes gas in the combustion chamber, wherein the plasma device, at a timing of igniting mixture gas in the combustion chamber, causes the ionization unit to ionize the gas in the combustion chamber, while causing the electromagnetic wave emission unit to emit the electromagnetic wave to the combustion chamber, thereby generating electromagnetic wave plasma.

5. The plasma device according to claim 2, further comprising an ionization unit that ionizes gas in the combustion chamber, wherein the plasma device, at a timing of igniting mixture gas in the combustion chamber, causes the ionization unit to ionize the gas in the combustion chamber, while causing the electromagnetic wave emission unit to emit the electromagnetic wave to the combustion chamber, thereby generating electromagnetic wave plasma.

6. The plasma device according to claim 1, wherein the electric wire comprises:

a first portion which is located on the valve head of an intake valve, a second portion which is located on the valve head of an exhaust valve, and a third portion which is located on a surface of the cylinder head, wherein the electric wire forms a coil when both the intake valve and the exhaust valve are closed.

* * * * *